United States Patent [19]

Brittin

[11] 4,334,722

[45] Jun. 15, 1982

[54] DESK MOUNTED CHAIR STOP

[76] Inventor: Willard D. Brittin, 1507 Elder La., Des Moines, Iowa 50315

[21] Appl. No.: 123,735

[22] Filed: Feb. 22, 1980

[51] Int. Cl.[3] ..... A47B 83/02; F16M 13/00

[52] U.S. Cl. ..... 312/194; 312/239; 297/140; 248/573

[58] Field of Search ..... 312/194, 239; 248/345.1, 264, 573, 574; 211/123; 297/140; 108/50

[56] References Cited

U.S. PATENT DOCUMENTS

| | | | |
|---|---|---|---|
| 598,105 | 2/1898 | Lind | 248/574 |
| 1,722,757 | 7/1929 | Levine | 248/264 |
| 2,196,933 | 4/1940 | Mooar | 248/345.1 |
| 2,202,196 | 5/1940 | Ducati | 297/140 |
| 2,271,007 | 1/1942 | Hanna | 297/140 |
| 2,597,578 | 5/1952 | Ganter | 248/264 |
| 2,664,147 | 12/1953 | O'Keefe et al. | 312/239 |
| 2,746,203 | 5/1956 | Gibas | 248/345.1 |
| 2,748,836 | 6/1956 | Olsson | 297/140 |
| 3,865,336 | 2/1975 | Robertson | 211/123 |
| 3,961,822 | 6/1976 | Daniel | 312/194 |

FOREIGN PATENT DOCUMENTS

| | | | |
|---|---|---|---|
| 871056 | 2/1953 | Fed. Rep. of Germany | 312/194 |
| 625553 | 8/1927 | France | 297/140 |
| 99677 | 1/1962 | Norway | 297/140 |

*Primary Examiner*—Victor N. Sakran

*Attorney, Agent, or Firm*—Zarley, McKee, Thomte, Voodrhees & Sease

[57] ABSTRACT

A desk having a knee space includes a stop secured to the desk in the travel path of the chair such that the seat engages the stop before the back engages the desk for protecting the back against being marred by the desk. The stop may be connected to the top wall of the knee space or extend between the side walls.

4 Claims, 6 Drawing Figures

DESK MOUNTED CHAIR STOP

BACKGROUND OF THE INVENTION

The ordinary desk and chair includes a chair having a seat portion adapted to be positioned in the knee space of the desk when it is not being used with the back of the chair engaging the front side of the desk. The point of engagement includes scratches and blemishes which inevitably make the chair and sometimes the desk, unsightly and therefore in need of being replaced periodically.

This problem is particularly common in hotels and motels since most rooms include a desk and chair. When the desk is not being used the chair is stored away with the seat portion in the knee space of the desk and the back of the chair rubs against the front of the desk marring up at least the front face of the chair back.

Accordingly, a desk-chair combination is needed that has means for preventing the chair from being marred by the desk when the chair is stored in nesting relationship in the desk knee space.

SUMMARY OF THE INVENTION

A stop member extends into the knee space of a desk in the path of travel of a mating chair which is adapted to have its seat portion positioned in the knee space. The stop is positioned such that the front edge of the seat will engage the stop before the front face of the back engages the forward edge of the desk thereby preventing either the chair back or desk front from being marred by one rubbing on the other.

The stop may be L-shaped and have one leg extending downwardly into the knee space with the other leg attached to the bottom side of the desk top or to the bottom side of the desk drawer. An alternate stop includes a vertically disposed sheet member extending between opposite side walls at a height such that it will engage the front edge of the seat portion of a chair before the back portion engages the front edge of the desk. Brackets may be provided which allow the sheet member to be quickly and easily mounted on the desk or removed therefrom.

DESCRIPTION OF THE PREFERRED EMBODIMENT

Figure 1:
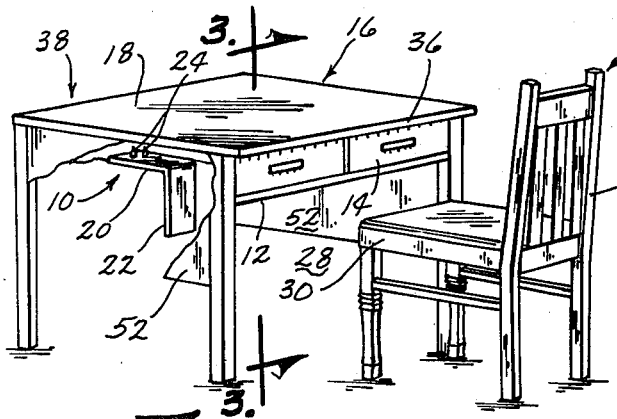
FIG. 1 is a perspective view of a desk and chair combination with the desk having an L-shaped chair stop mounted on the bottom side of a drawer.
Figure 2:
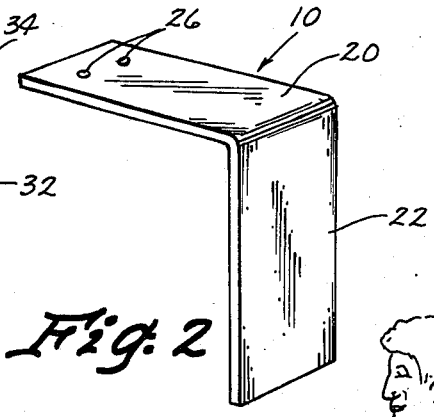
FIG. 2 is a perspective view of the L-shaped stop.

The chair stop of this invention is referred to generally in FIG. 1 by the reference numeral 10 and is shown mounted on the bottom side 12 of a desk drawer 14 in a desk 16 having a top working surface 18.

The chair stop is L-shaped having leg portions 20 and 22 with the leg portion 20 being connected to the bottom side 12 of the drawer 14 by screws 24 received in holes 26. The downwardly extending leg 22 is positioned in the knee space 28 in the travel path of the forward edge of a chair seat 30 such that the chair seat engages the stop leg 22 before the back 32 of the chair 34 engages the front edge 36 of the desk 38 thereby leaving a space 40 between the chair back 32 and the front edge 36 of the desk 38.

The chair stop 10 may be made of any suitable material but preferably is made from a single sheet of plastic material molded into the L-shape illustrated.

Figure 3:
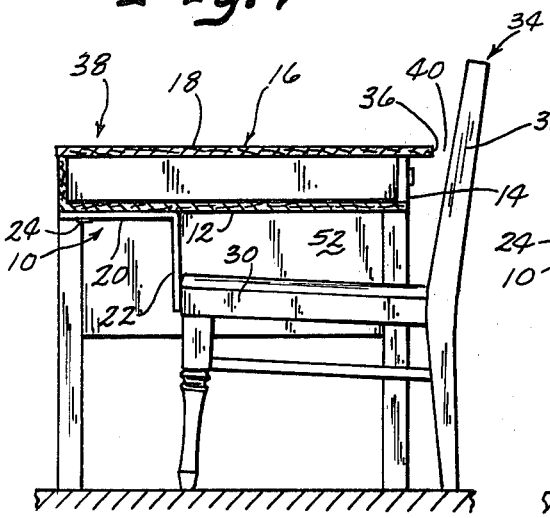
FIG. 3 is a cross-sectional view taken along line 3—3 in FIG. 1, with the chair engaging the stop and the chair back being spaced from the forward edge of the desk.
Figure 4:
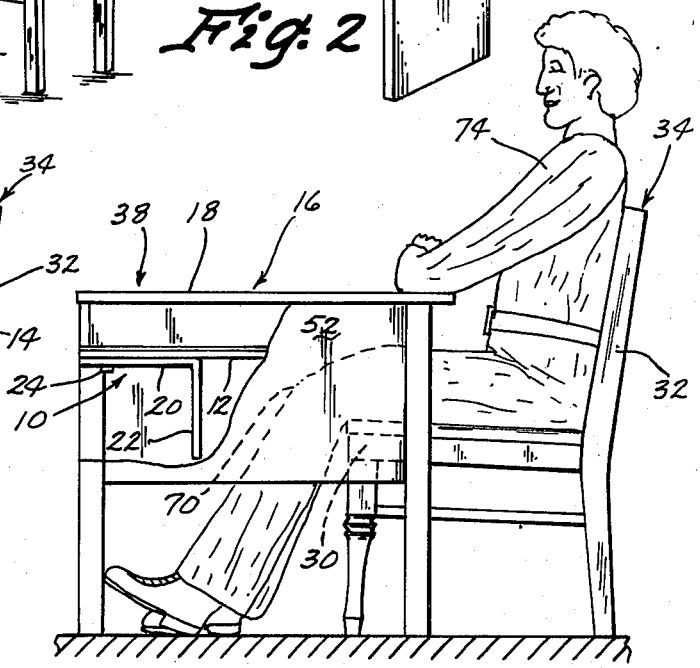
FIG. 4 is a fragmentary end elevational view similar to FIG. 3 but showing the person using the desk sitting on the chair without interference from the chair stop.
Figure 5:
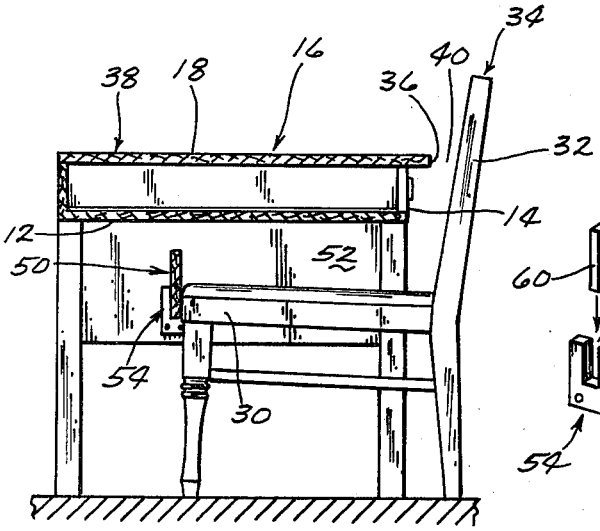
FIG. 5 is a view similar to FIG. 3 but showing an alternate embodiment of the chair stop.
Figure 6:
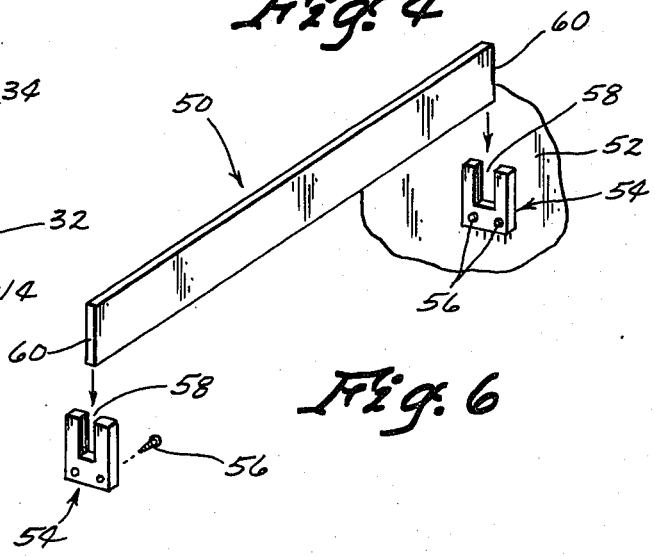
FIG. 6 is a fragmentary exploded perspective view of the chair stop of FIG. 5.

An alternate embodiment of the chair stop is illustrated in FIGS. 5 and 6 and includes an elongated sheet of plastic material 50 oriented in a vertical plane and secured to opposite side walls 52 of the desk 38 by mounting brackets 54 secured thereon by screws 56. The brackets 54 include upwardly facing slots 58 adapted to receive the opposite ends 60 of the sheet material 50. Thus it is seen that the sheet material 50 is easily mounted in the knee space or removed therefrom should such be desired although it is not believed that it would be necessary to remove the stop since it would not interfere in any way with the use of the desk. It is seen in FIG. 4, for example, that the person's knees 70 have ample clearance from the downwardly extending leg 22 of the stop 10 such that the person 74 need not even be aware that the stop is mounted on the desk. Even when the person places the chair 34 under the desk, as seen in FIGS. 3 or 5, it is not likely he will realize that there is a stop in the knee space that limits the travel of the chair under the desk.

Thus it is seen that through use of the stop 10 or the stop 50 that the opposing surfaces of the desk 38 and the chair back 32 will be protected and maintained free of scratches and blemishes by never being allowed to contact each other due to the front edge 30 of the chair seat engaging the stop before the back 32 can engage the forward edge 36 of the desk stop 16. It is noted that since the stop is made of a smooth, flat, plastic material which is adapted to engage the front edge 30 of the seat portion of the chair, the chair will not be marred by the stop. It is further noted that the stop may be mounted to the desk in different ways and may be made of different materials all contemplates by this invention.

I claim:

1. An unattached desk and chair in combination wherein the desk and chair are freestanding and independent thereof, comprising, a desk having a knee space defined by a top and opposite side walls, a stop mounted on said desk extending downwardly from the bottom of the desk top into the center of said knee space, and a chair having back and seat portions, with said seat portion having a forward edge, said chair adapted to be positioned with said seat in said knee space with said seat portion engaging along its forward edge only, said stop and said stop being positioned such that the back of the chair is permitted to move closely adjacent the back edge of desk top without making contact therewith.

2. The structure of claim 1 wherein said desk includes a drawer having a bottom wall which includes the top wall of said knee space and said stop is mounted on said bottom wall.

3. The structure of claim 2 wherein said stop is L-shaped and includes a pair of legs, one of which extends into said knee space and the other extends parallel to and in mating engagement with said top wall.

4. The structure of claim 3 wherein said L-shaped stop is made of a single piece of plastic material.

* * * * *